US006958742B2

(12) United States Patent
Date et al.

(10) Patent No.: US 6,958,742 B2
(45) Date of Patent: Oct. 25, 2005

(54) CURRENT DRIVE SYSTEM

(75) Inventors: Yoshito Date, Shiga (JP); Tetsuro Omori, Osaka (JP); Makoto Mizuki, Kyoto (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 37 days.

(21) Appl. No.: 10/795,390

(22) Filed: Mar. 9, 2004

(65) Prior Publication Data

US 2004/0178742 A1 Sep. 16, 2004

(30) Foreign Application Priority Data

Mar. 14, 2003 (JP) ..... 2003-069536

(51) Int. Cl.[7] ..... G09G 3/36
(52) U.S. Cl. ..... 345/90
(58) Field of Search ..... 345/90, 204, 60; 315/169.3; 327/108

(56) References Cited

U.S. PATENT DOCUMENTS 5,594,373 A * 1/1997 McClure ..... 327/108
5,856,749 A * 1/1999 Wu ..... 327/66
6,037,807 A * 3/2000 Wu et al. ..... 327/52
6,225,844 B1 * 5/2001 Fujiwara ..... 327/170
6,897,619 B2 * 5/2005 Shimizu ..... 315/169.3
2003/0011408 A1 * 1/2003 Tsuchi ..... 327/108
2003/0048125 A1 * 3/2003 Miyazaki et al. ..... 327/534
2003/0132930 A1 * 7/2003 Kimura et al. ..... 345/211
2005/0068076 A1 * 3/2005 Iroaga ..... 327/158
2005/0088396 A1 * 4/2005 Tobita ..... 345/100

FOREIGN PATENT DOCUMENTS

JP 11-88072 3/1999
JP 11-340785 12/1999

* cited by examiner

*Primary Examiner*—Don Wong
*Assistant Examiner*—Angela M. Lie
(74) *Attorney, Agent, or Firm*—McDermott Will & Emery LLP

(57) ABSTRACT

In a current drive system for current-driving a display panel such as an organic EL panel, display crosstalk caused by a bias-voltage variation due to induction from the display panel is prevented. For this prevention, the current drive system includes: a plurality of drivers for current-driving a plurality of display element circuits in the display panel; and a bias circuit with a low output impedance for generating a bias voltage and supplying the bias voltage to each of the drivers through a bias line. The output impedance of the bias circuit is set sufficiently low so that a voltage variation caused on the bias line due to switching operation of each switch in the drivers converges within a period during which display data is written.

22 Claims, 13 Drawing Sheets

CURRENT DRIVE SYSTEM

BACKGROUND OF THE INVENTION

The present invention relates to current drive systems, and particularly relates to techniques with current drive systems suitable as display drivers for organic EL (Electro Luminescence) panels.

In recent years, flat panel displays such as organic EL panels have grown in size and definition and have become thinner, lighter and less expensive. In driving large and high-definition display panels, an active matrix type is preferably chosen in general. Hereinafter, a conventional display driver for an active matrix type display panel will be described.

FIG. 10 shows a circuit configuration of a current drive system as a conventional display driver connected to a display panel. A current drive system 100 includes: m drivers 11-1 to 11-m for current-driving respective display element circuits 21-1 to 21-m in a display panel 20; and a bias circuit 12 for generating a bias voltage Vb and supplying the bias voltage Vb to the driver 11-i (where i is an integer from 1 through m). The display panel 20 is an organic EL panel.

The bias circuit 12 includes: a current mirror circuit 123 having p-type transistors 121 and 122 at its input and output sides, respectively; a resister 124 connected to the p-type transistor 121 and allowing a reference current Iref to flow at the input side of the current mirror circuit 123; and an n-type transistor 125 connected to the p-type transistor 122, receiving a mirrored bias current Ib at the output side of the current mirror circuit 123 to generate the bias voltage Vb.

The driver 11-i includes: n n-type transistors 111-1 to 111-n; and switches 112-1 to 112-n associated with the respective n-type transistors 111-1 to 111-n. For example, if n is 63, the driver 11-i is capable of producing a display of six bits, i.e., 64 levels of gray scale.

The gates of the n-type transistors 111-1 to 111-n in the current drive system 100 are connected to each other through a bias line 13 extending from the gate and drain of the n-type transistor 125 in the bias circuit 12 and receive the bias voltage Vb in common. That is, the n-type transistor 111-j (where j is an integer from 1 through n) forms a current mirror circuit together with the n-type transistor 125. The n-type transistor 111-j draws a current mirrored from the bias current Ib between the source and drain thereof.

The switch 112-j is connected to an output terminal 113-i of the driver 11-i at one end and is connected to the n-type transistor 111-j at the other end. The switch 112-j performs switching operation independently of the other switches based on display data (not shown).

Specifically, the driver 11-i substantially operates as a current mode D/A converter, receives display data as a digital signal and draws a current in an amount corresponding to the display data as an analog signal through the output terminal 113-i.

Each display element circuit 21-i corresponds to one pixel in the display panel 20. The display element circuit 21-i includes: an organic EL device 211; a TFT (Thin Film Transistor) 212 connected to the organic EL device 211; and a TFT 213 forming a current mirror together with the TFT 212.

As well known in the art, an organic EL device exhibits rectification as a diode and has its luminance changed depending on the amount of flowing current. Specifically, in the display element circuit 21-i, the amount of a current flowing in the organic EL device 211 varies depending on the amount of a current flowing in the TFT 213, which is connected to the driver 11-i via a drive line 30-i. Accordingly, the organic EL device 211 is current-driven by the driver 11-i to have its luminance changed.

In this manner, the current drive system 100 current-drives the plurality of display element circuits 21-1 to 21-m in the display panel 20 based on display data, thereby producing a gray-scale display (see, for example, Japanese Laid-Open Publication Nos. 11-88072 and 11-340765).

However, in the case of displaying specific display data with the conventional current drive system 100, the display might be distorted by injection of charge from the display panel 20 or instantaneous variation of the bias voltage. That is, so-called display crosstalk might occur. Hereinafter, it will be described how the display crosstalk occurs.

FIG. 11 shows a state of the current drive system 100 when the current drive system 100 is induced from the display panel 20. Though all the switches 112-1 to 112-n in the driver 11-1 are OFF in FIG. 10, the switches 112-1 to 112-n are ON in FIG. 11.

FIGS. 12A and 12B show respective examples of a display on the display panel 20. A display associated with a scan line shown in FIG. 12A corresponds to the operation state of the current drive system 100 shown in FIG. 10. A display associated with a scan line shown in FIG. 12B corresponds to the operation state of the current drive system 100 shown in FIG. 11.

In an organic EL panel, during one horizontal period, display data is written into pixels (display element circuits) on a scan line and, when this write operation is completed, a next scan line is selected so that other display data is written, as in a hold-type display panel such as a liquid crystal panel. In actual application, capacitances (not shown) for holding data are provided in the display element circuits, and these capacitances hold a voltage associated with display data until the next frame is selected. This allows the display element circuit 21-i to maintain a constant luminous state even if the display element circuit 21-i is electrically separated from the driver 11-i.

In the display associated with the scan line shown in FIG. 12A, the left part of the scan line exhibits the minimum luminance (black display) and the right part thereof exhibits the maximum luminance (white display). In this case, in the current drive system 100, all the switches 112-1 to 112-n in the driver 11-1 are OFF as shown in FIG. 10, so that the amount of a current drawn from the output terminal 113-1 is substantially zero. Accordingly, the organic EL device 211 in the display element circuit 21-1 is in a nonluminous state. On the other hand, all the switches 112-1 to 112-n in the driver 11-m are ON, so that the amount of a current drawn from the output terminal 113-m is at the maximum. Accordingly, the organic EL device 211 in the display element circuit 21-m is in a luminous state with the maximum luminance.

FIGS. 13A and 13B are graphs showing IV characteristics of the driver 11-i and display TFTs. As shown in FIG. 13A, the drivers 11-1 and 11-m produce a black display and a white display, respectively, unlike the TFTs 212 and 213 which exhibit a constant IV characteristic. FIG. 13A shows that the voltage V1 at the operating point of the black-display TFT is relatively high and can be close to the power-supply voltage. On the other hand, the voltage V2 at the operating point of the white-display TFT is lower than the voltage V1 at the operating point of the black-display TFT. These operating-point voltages V1 and V2 vary depending on the ON resistances of the TFTs and the amount of a current drawn into the driver 11-i.

FIG. 12B shows an example of a display when the left part of the scan line comes to have the maximum luminance immediately after continuation of the same display as the display associated with the scan line shown in FIG. 12A. At this time, in the current drive system 100, all the switches 112-1 to 112-n in the driver 11-1 are ON as shown in FIG. 11 so that the maximum amount of current is drawn through the output terminal 113-1. In this manner, the organic EL element 211 in the display element circuit 21-1 is in a luminous state with the maximum luminance.

In this case, charge accumulated in a parasitic capacitance 31-1 is injected into the driver 11-1 through the drive line 30-1. The parasitic capacitance 30-1 is considered to be a combination of parasitic capacitances present in the current drive system 100, display panel 20 and drive line 30-1.

If the amount of charge to be injected is relatively small, the charge passes through the n-type transistors 111-1 to 111-n to reach the ground. However, since the display element circuit 21-1 had been producing a black display immediately before the state shown in FIG. 12B, the parasitic capacitance 31-1 is charged at a voltage near the power-supply voltage. Accordingly, at the moment at which the driver 11-1 and the drive line 30-1 are electrically connected to each other, a voltage close to the power-supply voltage is applied to the drain of the n-type transistor 111-i, resulting in that the bias line 13 is disadvantageously induced through a parasitic capacitance Cgd present between the gate and drain thereof. A waveform 14 shown in FIG. 11 represents a voltage variation caused on the bias line 13 by this induction.

If a rising voltage as shown by the waveform 14 shown in FIG. 11 occurs on the bias line 13, the amount of a drive current in the other drivers, e.g., the driver 11-m temporarily increases though display data does not change. As a result, as shown in the graph shown in FIG. 13B, the driver 11-m is in an overdrive state.

If the voltage variation on the bias line 13 converges within a period during which display data is written, the driver 11-m returns to a given drive state so that a normal display is produced. However, if the voltage variation does not converge within the display-data writing period, the display element circuit 21-m remains in the overdrive state until the next frame is selected, resulting in display crosstalk in which an emission line is visually recognized.

In contrast, in a case where the display driven by the driver 11-i is switched from white to black, a temporary drop of the voltage occurs on the bias line 13. This causes display crosstalk in which a dark line having decreased luminance is visually recognized.

The parasitic capacitance 31-i is in the range from several pF to several tens pF in the case of small panels for portable use, but can be 100 pF or more in the case of large panels. Accordingly, if the display panel becomes larger in size, display crosstalk is more noticeable. In particular, a current drive system for an organic EL panel drives display element circuits by a very small amount of current of about several tens nA, so that display crosstalk is liable to occur. In recent years, current drive systems serving as display drivers for flat panel displays have been required to be able to reduce variation between output terminals as well as to enhance uniformity in displayed image quality. To meet these demands, the display crosstalk should be avoided in order to enhance the uniformity in displayed image quality.

SUMMARY OF THE INVENTION

It is therefore an object of the present invention to provide a current drive system which is used for driving a display panel and avoids display crosstalk and achieving display uniformity. It is also another object of the present invention to reduce power consumption of the current drive system.

In order to achieve these objects, an inventive current drive system as a current drive system for current-driving a plurality of display element circuits in a display panel includes: a plurality of drivers associated with the respective display element circuits, each of the drivers including at least one transistor whose gate is connected to a bias line and which allows a current in an amount corresponding to a bias voltage applied through the bias line to flow between the source and drain of the transistor and at least one switch associated with the transistor and performing switching operation based on display data to electrically connect or disconnect the transistor to/from a drive line for driving an associated one of the display element circuits; and a bias circuit having an output impedance which is low enough to have a voltage variation occurring on the bias line due to the switching operation of the switch converge within a period during which the display data is written, the bias circuit generating the bias voltage and outputting the bias voltage to the bias line.

With this configuration, the output impedance of the bias circuit is sufficiently low so that a voltage variation occurring on the bias line due to the switching operation of the switch in the driver converges within a period during which display data is written. As a result, display crosstalk is avoided.

The bias circuit preferably includes impedance reducing means for reducing the output impedance of the bias circuit and outputting the bias voltage based on a received reference voltage.

The bias circuit more preferably includes: a current mirror circuit for generating a bias current in an amount corresponding to the amount of a current obtained by multiplying a received reference current by a given mirror ratio; and a voltage generator for receiving the bias current generated by the current mirror circuit and generating the reference voltage.

The inventive current drive system preferably further includes an output impedance switching circuit for switching the output impedance of the bias circuit in accordance with a static characteristic of the display panel.

With this configuration, display crosstalk is avoided with power consumption of the current drive system reduced by appropriately switching the output impedance of the bias circuit in accordance with various types of display panels.

To achieve the above-mentioned objects, another inventive current drive system as a current drive system for current-driving a plurality of display element circuits in a display panel includes: a plurality of drivers associated with the respective display element circuits, each of the drivers including at least one transistor whose gate is connected to a bias line and which allows a current in an amount corresponding to a bias voltage applied through the bias line to flow between the source and drain of the transistor and at least one switch associated with the transistor and performing switching operation based on display data to electrically connect or disconnect the transistor to/from a drive line for driving an associated one of the display element circuits; a bias circuit for generating the bias voltage and outputting the bias voltage to the bias line; and an output impedance switching circuit for setting an output impedance of the bias circuit relatively low in accordance with a pulse signal indicating a timing of writing the display data, during a given period starting with reception of the pulse signal.

With this configuration, the output impedance of the bias circuit is dynamically switched. As a result, power consumption of the current drive system is optimized with display crosstalk avoided.

The pulse signal preferably includes, in the given period, a pulse which holds a given logic level, and the output impedance switching circuit preferably sets the output impedance of the bias circuit relatively low while the pulse signal is at the given logic level.

To achieve the above-mentioned objects, another inventive current drive system as a current drive system for current-driving a plurality of display element circuits in a display panel includes a plurality of drivers associated with the respective display element circuits. In this system, each of the drivers includes: at least one transistor whose gate is connected to a bias line and which allows a current in an amount corresponding to a bias voltage applied through the bias line to flow between the source and drain of the transistor; and at least one switch associated with the transistor and performing switching operation based on display data to electrically connect or disconnect the transistor to/from a drive line for driving an associated one of the display element circuits; and current limiting means for limiting a current flowing from the drive line while the switch is ON such that a voltage variation on the bias line caused by the current converges within a period during which the display data is written.

With this configuration, the bias line is less affected by induction from the drive line. As a result, display crosstalk is avoided.

The switch is preferably a transistor for switching between connection and disconnection between the source and drain thereof based on a control voltage applied to the gate thereof, and also preferably substantially serves as the current limiting means to limit the amount of a current flowing between the source and the drain in a connection state based on the control voltage.

To achieve the above-mentioned objects, another inventive current drive system as a current drive system for current-driving a plurality of display element circuits in a display panel includes: a plurality of drivers associated with the respective display element circuits, each of the drivers including at least one transistor whose gate is connected to a bias line and which allows a current in an amount corresponding to a bias voltage applied through the bias line to flow between the source and drain of the transistor and at least one switch associated with the transistor and performing switching operation based on display data to electrically connect or disconnect the transistor to/from a drive line for driving an associated one of the display element circuits; a bias circuit for generating the bias voltage and outputting the bias voltage to the bias line; and an output impedance switching circuit for switching an output impedance of the bias circuit in accordance with a static characteristic of the display panel.

With this configuration, power consumption of the current drive system is reduced by appropriately switching the output impedance of the bias circuit in accordance with various types of display panels.

Specifically, the static characteristic of the display panel may be a parasitic capacitance on the drive line, and the output impedance switching circuit may set the output impedance of the bias circuit relatively low if the parasitic capacitance is relatively large, while setting the output impedance of the bias circuit relatively high if the parasitic capacitance is relatively small.

Alternatively, the static characteristic of the display panel may be a power-supply voltage in the display panel, and the output impedance switching circuit may set the output impedance of the bias circuit relatively low if the power-supply voltage is relatively high, while setting the output impedance of the bias circuit relatively high if the power-supply voltage is relatively low.

The circuit drive system preferably further includes a characteristic information holding circuit for holding information on the static characteristic of the display panel, wherein the output impedance switching circuit switches the output impedance of the bias circuit based on the information held by the characteristic information holding circuit.

Specifically, the bias circuit may include: a current mirror circuit for generating a bias current in an amount corresponding to the amount of a current obtained by multiplying a received reference current by a given mirror ratio; and a voltage generator having a given resistance value, receiving the bias current generated by the current mirror circuit and generating the bias voltage at a level according to the given resistance value, and the output impedance switching circuit may switch a mirror ratio of the current mirror circuit and the resistance value of the voltage generator, in accordance with the static characteristic of the display panel.

Alternatively, the bias circuit may include: a current mirror circuit for generating a bias current in an amount corresponding to the amount of a current obtained by multiplying a received reference current by a given mirror ratio; and a voltage generator having a given resistance value, receiving the bias current generated by the current mirror circuit and generating the bias voltage at a level according to the given resistance value, the output impedance switching circuit may switch the resistance value of the voltage generator in accordance with the static characteristic of the display panel, an the amount of the reference current may be switched in accordance with switching of the resistance value of the voltage generator.

DESCRIPTION OF THE PREFERRED EMBODIMENTS

A current drive system according to the present invention is applicable as a display driver for driving a panel such as an organic EL panel or a liquid crystal panel. In addition, the inventive current drive system can be integrated on one chip to be implemented as LSI serving as a display driver. Hereinafter, preferred embodiments of the present invention will be described with reference to the drawings.

Embodiment 1

Figure 1:
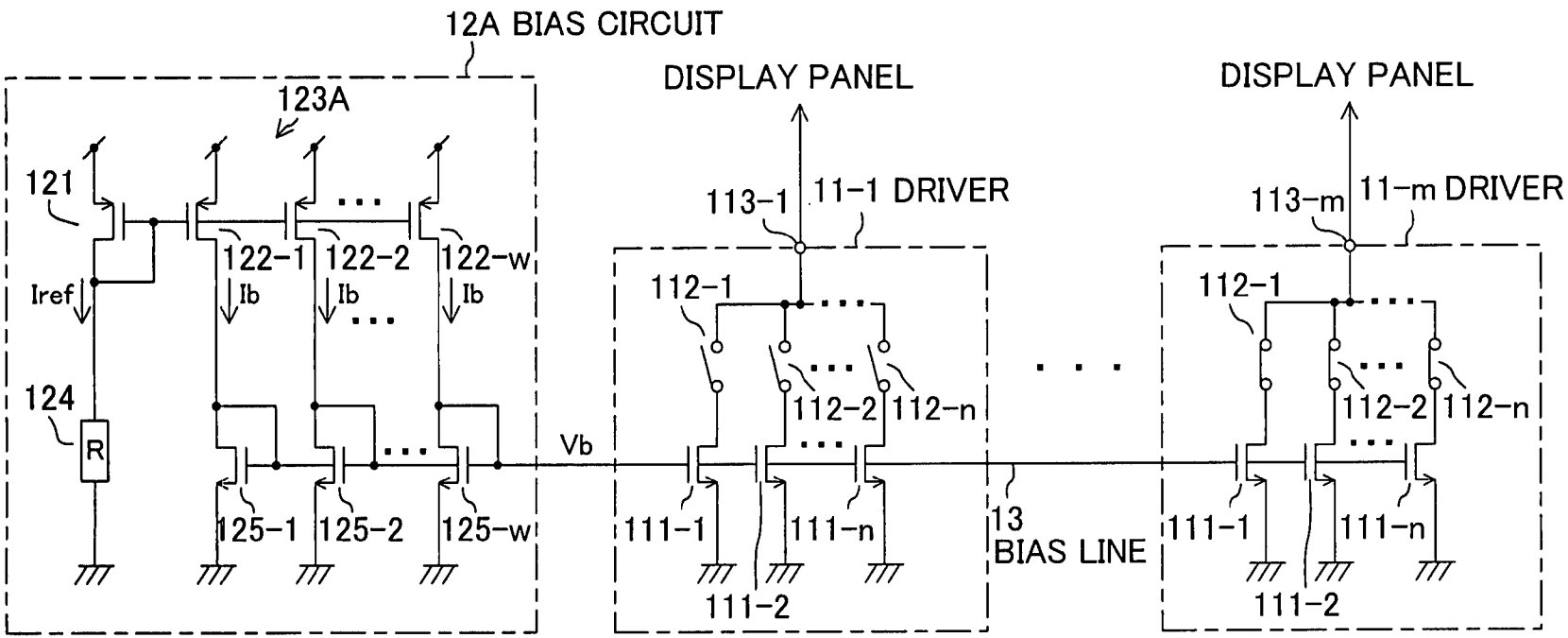
FIG. 1 is a circuit diagram showing a current drive system according to a first embodiment of the present invention.

FIG. 1 shows a circuit configuration of a current drive system according to a first embodiment of the present invention. A current drive system 10A according to this embodiment includes: m drivers 11-1 to 11-m for driving a display panel; and a bias circuit 12A for generating a bias voltage Vb and supplying the bias voltage Vb to each driver 11-i. The driver 11-i is the same as that described in the conventional system, and thus the description thereof will be omitted. Hereinafter, the bias circuit 12A will be described.

The bias circuit 12A includes: a current mirror circuit 123A including a p-type transistor 121 at its input side and w p-type transistors 122-1 to 122-w connected in parallel at its output side; a resistor 124 connected to the p-type transistor 121 and allowing a reference current Iref to flow at the input side of the current mirror circuit 123A; and w n-type transistors 125-1 to 125-w as a voltage generator receiving a bias current Ib generated by the p-type transistor 122-k (where k is an integer from 1 to w) to generate a bias voltage Vb. The p-type transistor 122-k and the n-type transistor 125-k have characteristics similar to those of the p-type transistor 122 and the n-type transistor 125, respectively, in the bias circuit 12 shown in FIG. 10. That is, in the bias circuit 12A of this embodiment, the transistor size (i.e., gate width/gate length) at the side at which the bias voltage Vb is generated is larger than that in the conventional system.

By thus increasing the transistor size at the side at which the bias voltage Vb is generated, the output impedance of the bias circuit 12A to the bias line 13 is reduced. If the output impedance of the bias circuit 12A is reduced, the voltage variation, i.e., rising or falling of voltage, caused on the bias line 13 converges to a steady-state value in a shorter period. Accordingly, if the output impedance of the bias circuit 12A is reduced to such a degree that the voltage variation, i.e., rising or falling of voltage, caused on the bias line 13 converges within a period during which display data is written, display crosstalk is avoided.

As described above, in this embodiment, only by changing the transistor size at the output side of the bias circuit, a current drive system preventing display crosstalk and producing a uniform display is implemented relatively easily.

Embodiment 2

Figure 2:
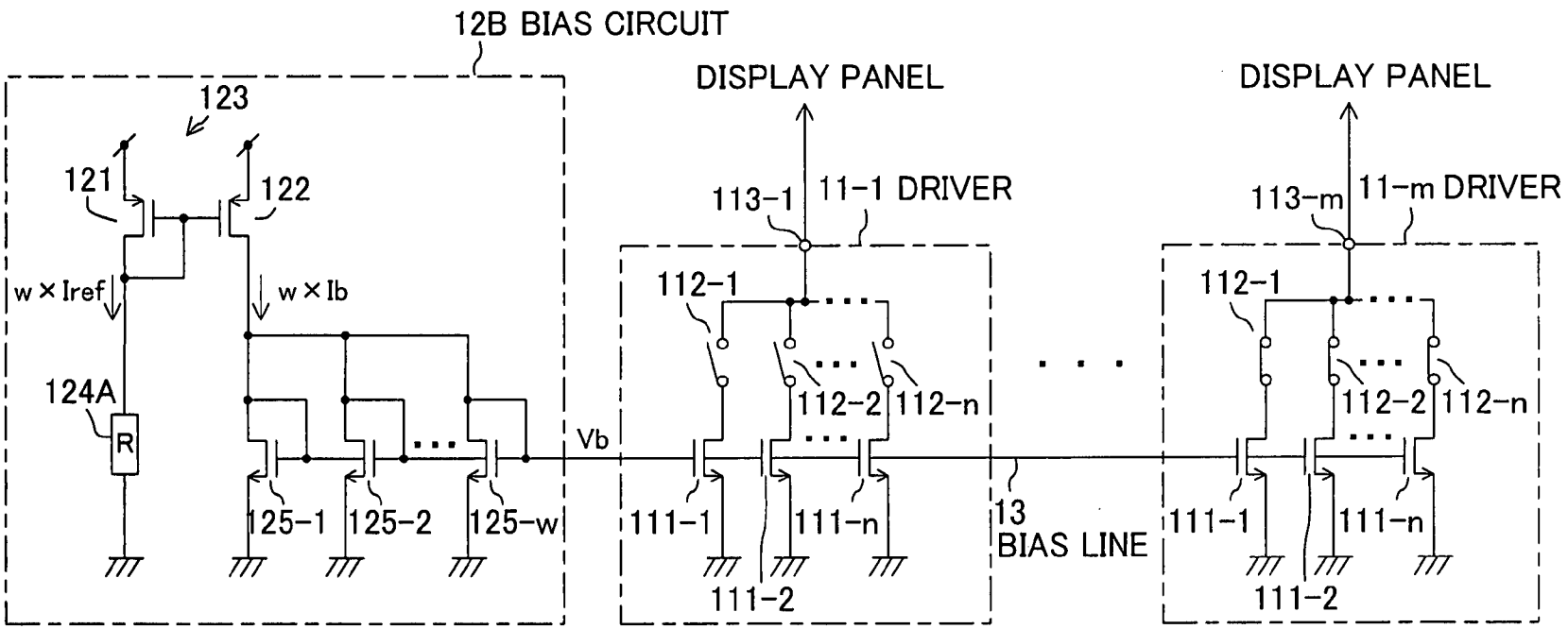
FIG. 2 is a circuit diagram showing a current drive system according to a second embodiment of the present invention.

FIG. 2 shows a circuit configuration of a current drive system according to a second embodiment of the present invention. A current drive system 10B according to this embodiment includes: m drivers 11-1 to 11-m for driving a display panel; and a bias circuit 12B for generating a bias voltage Vb and supplying the bias voltage Vb to each driver 11-i. The driver 11-i is the same as that described in the conventional system, and thus the description thereof will be omitted. Hereinafter, the bias circuit 12B will be described.

The bias circuit 12B includes: a current mirror circuit 123 having p-type transistors 121 and 122 at its input and output sides, respectively; a resistor 124A connected to the p-type transistor 121 and allowing a reference current Iref to flow at the input side of the current mirror circuit 123; and w n-type transistors 125-1 to 125-w as a voltage generator receiving a bias current generated at the output side of the current mirror circuit 123 to generate a bias voltage Vb. The n-type transistor 125-k has similar characteristics to those of the n-type transistor 125 in the bias circuit 12 shown in FIG. 10.

The bias circuit 12B receives a reference current w×Iref, which is obtained by multiplying the reference current Iref in the bias circuit 12 by the number of the n-type transistors 125-i. Accordingly, the bias current generated by the current mirror circuit 123 is expressed by w×Ib. This bias current is distributed among the n-type transistors 125-1 to 125-w which are connected in parallel. The n-type transistor 125-k generates a bias voltage Vb equal to the bias voltage generated by the bias circuit 12. That is, the bias circuit 12B of this embodiment has a configuration in which the reference current is increased and the transistor size at the side at which the bias voltage Vb is generated is increased, as compared to the conventional system.

By thus increasing the transistor size at the side at which the bias voltage Vb is generated, the output impedance of the bias circuit 12B to the bias line 13 is reduced. If the output impedance of the bias circuit 12B is reduced to such a degree that the voltage variation, i.e., rising or falling of voltage, caused on the bias line 13 converges within a period during which display data is written, display crosstalk is avoided.

As described above, in this embodiment, the number of transistors that need to be increased in size is smaller than in the first embodiment, so that a current drive system is implemented with a smaller circuit area.

Embodiment 3

Figure 3:
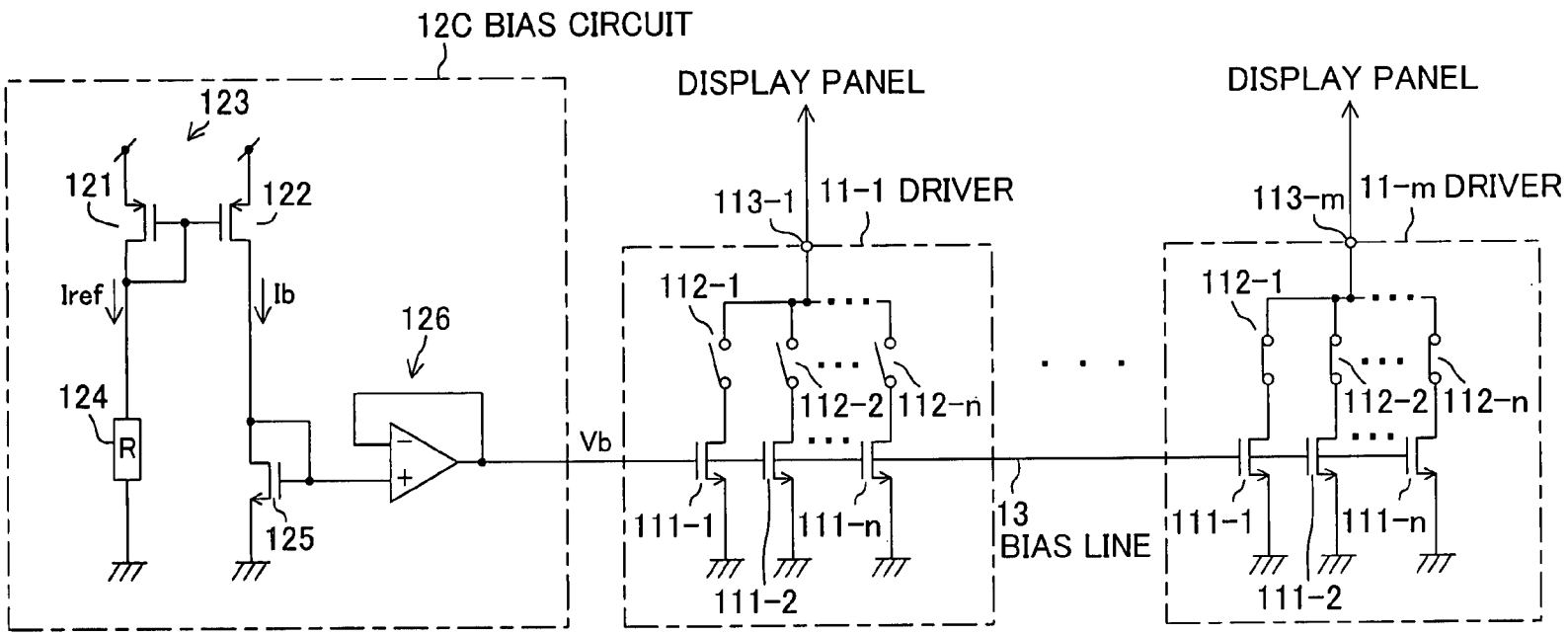
FIG. 3 is a circuit diagram showing a current drive system according to a third embodiment of the present invention.

FIG. 3 shows a circuit configuration of a current drive system according to a third embodiment of the present invention. A current drive system 10C according to this embodiment includes: m drivers 11-1 to 11-m for driving a display panel; and a bias circuit 12C for generating a bias voltage Vb and supplying the bias voltage Vb to the driver 11-i. The driver 11-i is the same as that described in the conventional system, and thus the description thereof will be omitted. Hereinafter, the bias circuit 12C will be described.

Figure 10:
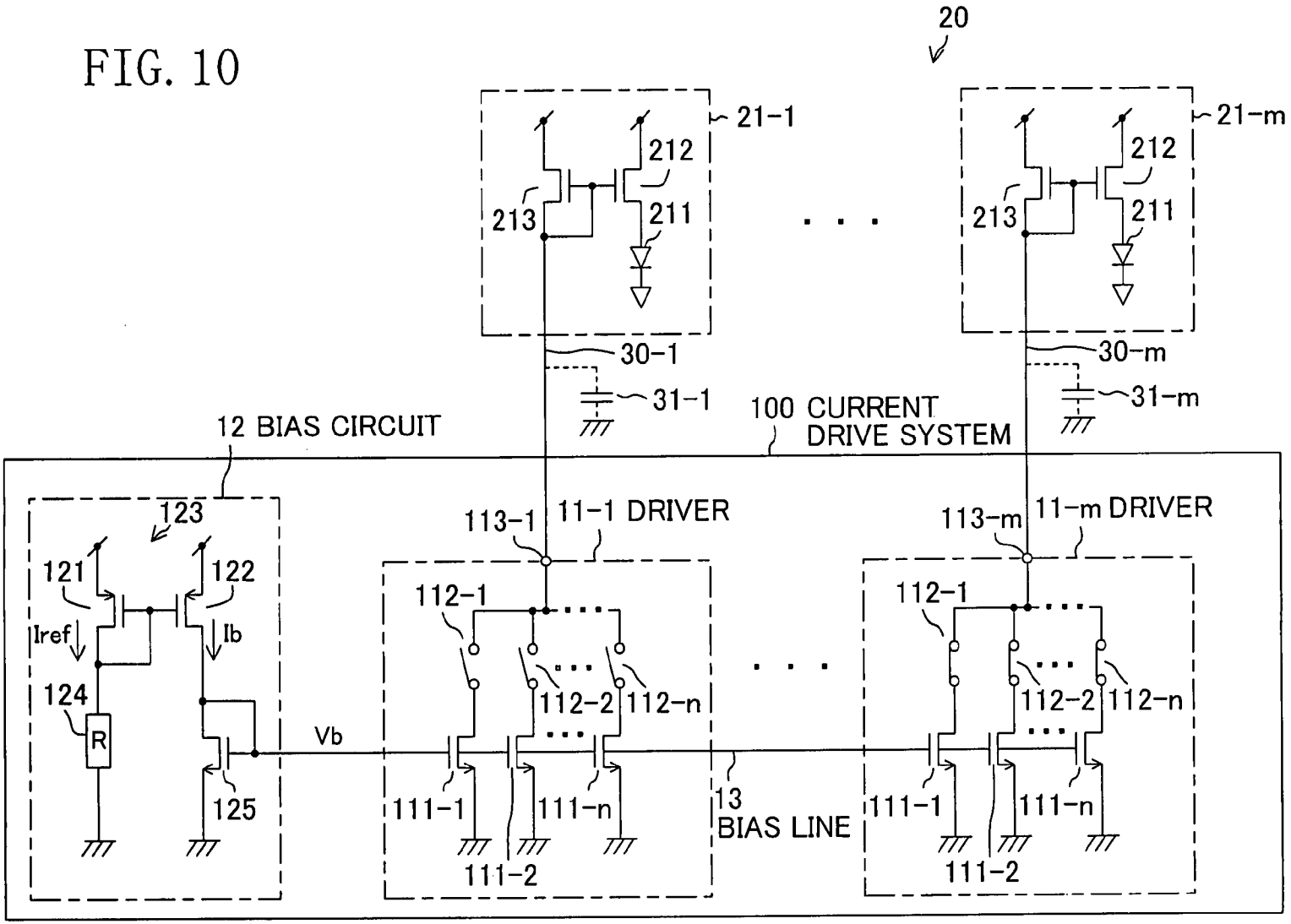
FIG. 10 is a circuit diagram showing a conventional current drive system connected to a display panel.
Figure 11:
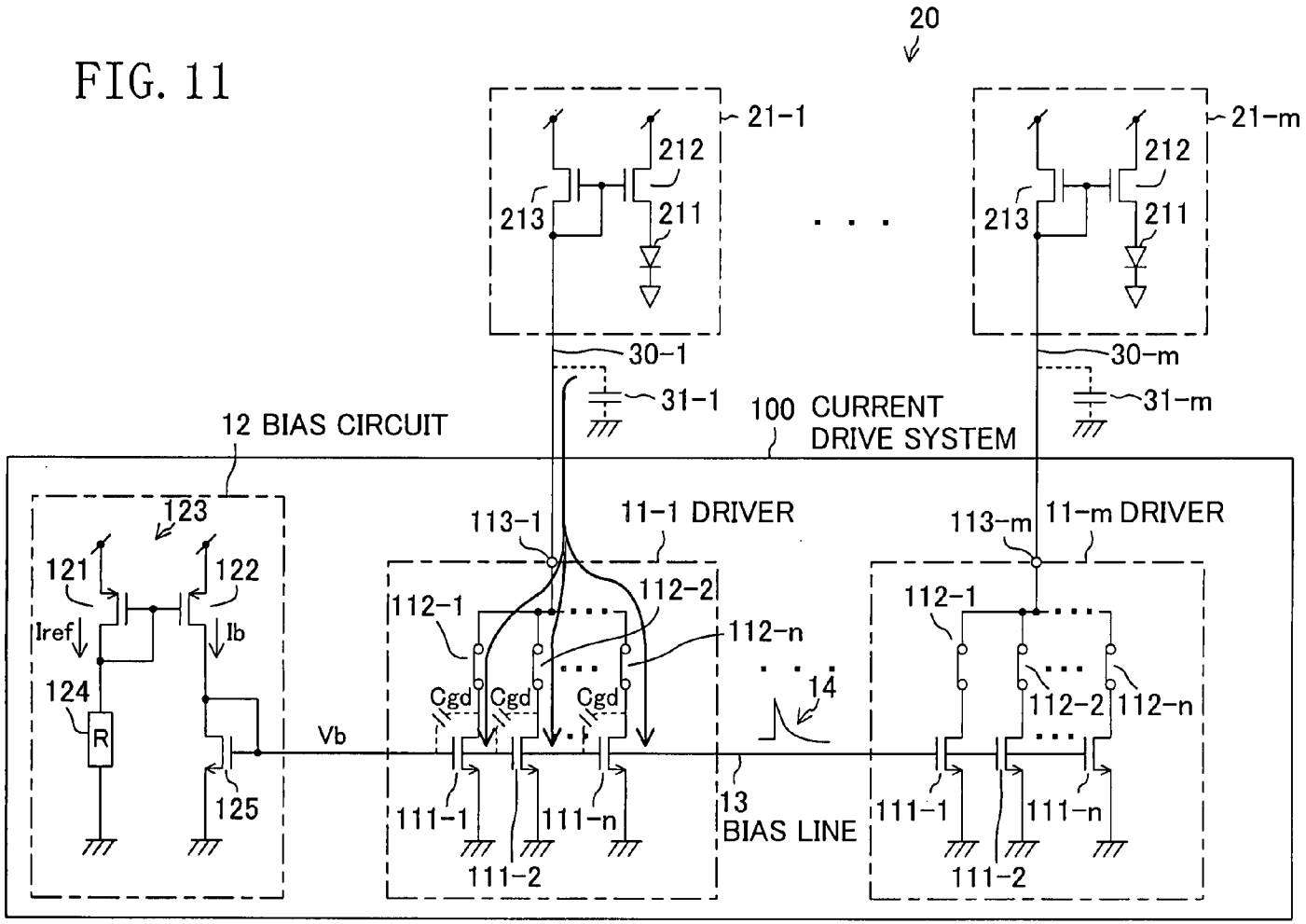
FIG. 11 is a diagram showing the conventional current drive system in a state in which the conventional system is inducted from the display panel.
Figure 12A:
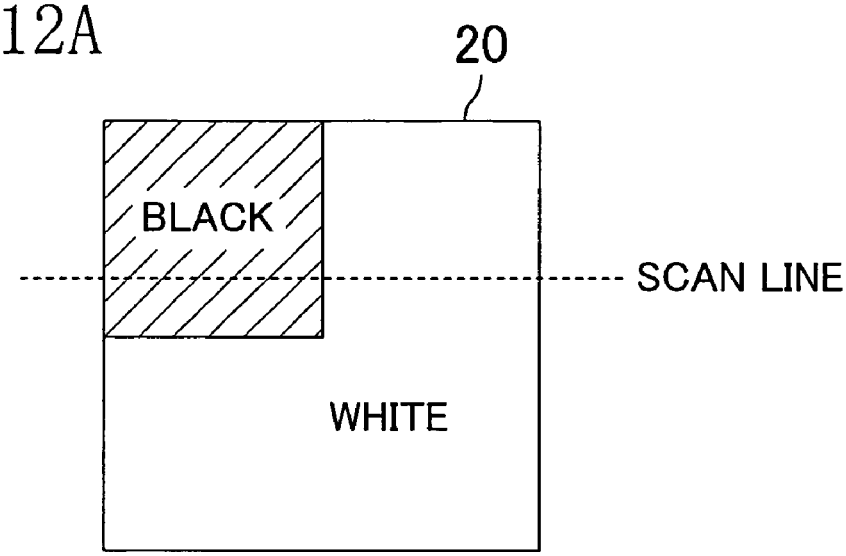
FIGS. 12A and 12B are examples of a display on the display panel.
Figure 12B:
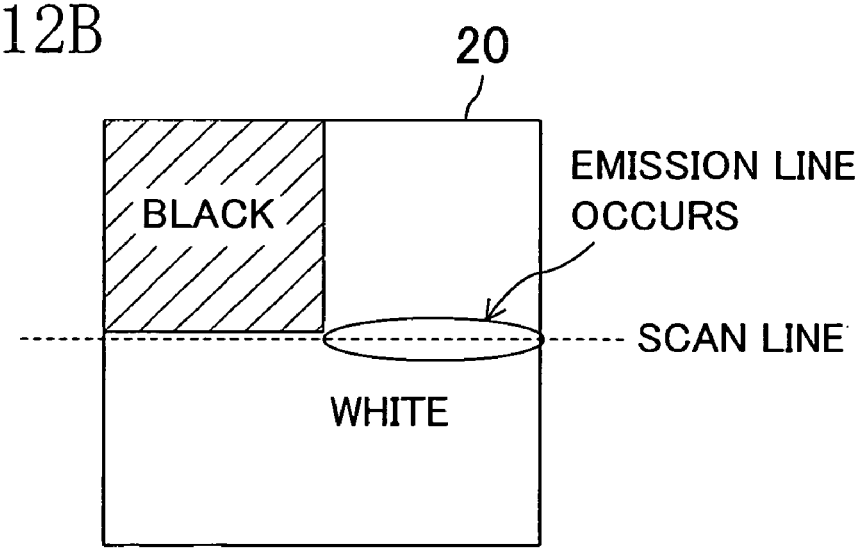
Figure 13A:
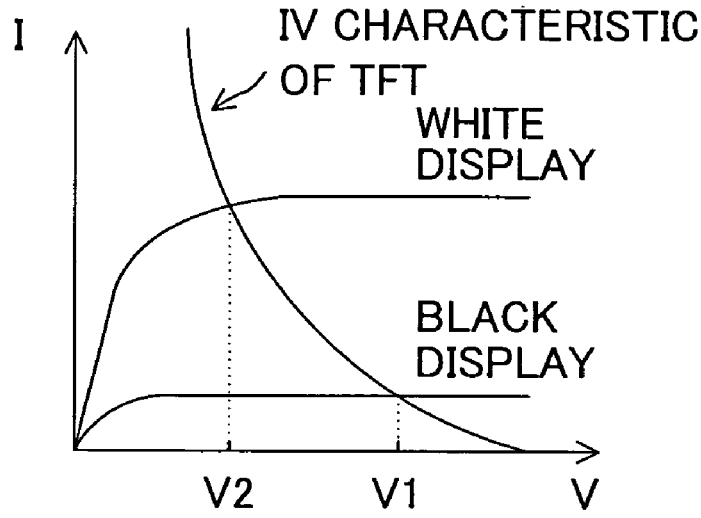
FIGS. 13A and 13B are graphs showing IV characteristics of drivers in the conventional current drive system and TFTs on the display panel.
Figure 13B:
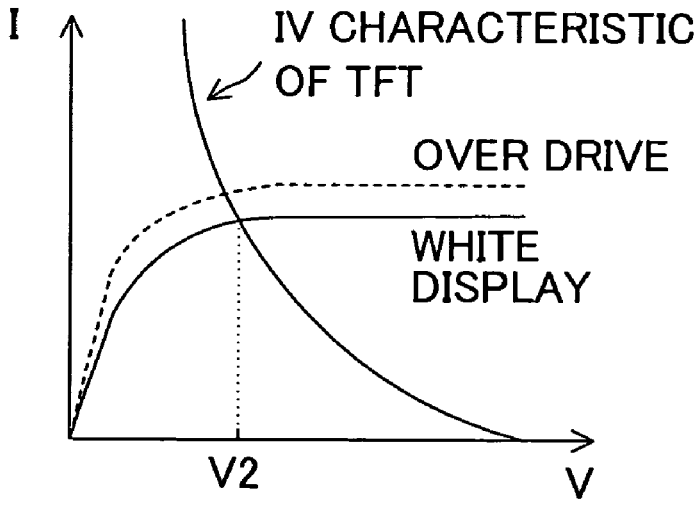

The bias circuit 12C has a configuration in which a voltage follower 126 as an impedance reducing means is provided at a subsequent stage in the bias circuit 12 shown in FIG. 10. As well known in the art, the voltage follower 126 has the function of impedance transformation, so that the output impedance of the bias circuit 12C can be set at almost zero. Accordingly, voltage variation, i.e., rising or falling of voltage, caused on a bias line 13 converges within a short period, thus avoiding display crosstalk.

The offset voltage of the voltage follower 126 varies depending on circuits. Therefore, it is preferable that the characteristic of response zero is provided or offset cancellation is performed.

As described above, in this embodiment, an impedance reducing means is inserted at the output side of the bias circuit 12C, thus implementing a current drive system avoiding display crosstalk and producing a uniform display.

Though a null amplifier using an operational amplifier is used as the impedance reducing means in this embodiment, a source follower amplifier or an emitter follower amplifier may be also used.

The voltage follower 126 does not necessarily receive, as a reference voltage, the bias voltage Vb generated by the bias circuit 12 shown in FIG. 10. For example, the current mirror circuit 123 and the n-type transistor 125 may be omitted and a reference voltage generated by an external power supply may be directly applied to the voltage follower 126.

Embodiment 4

Figure 4:
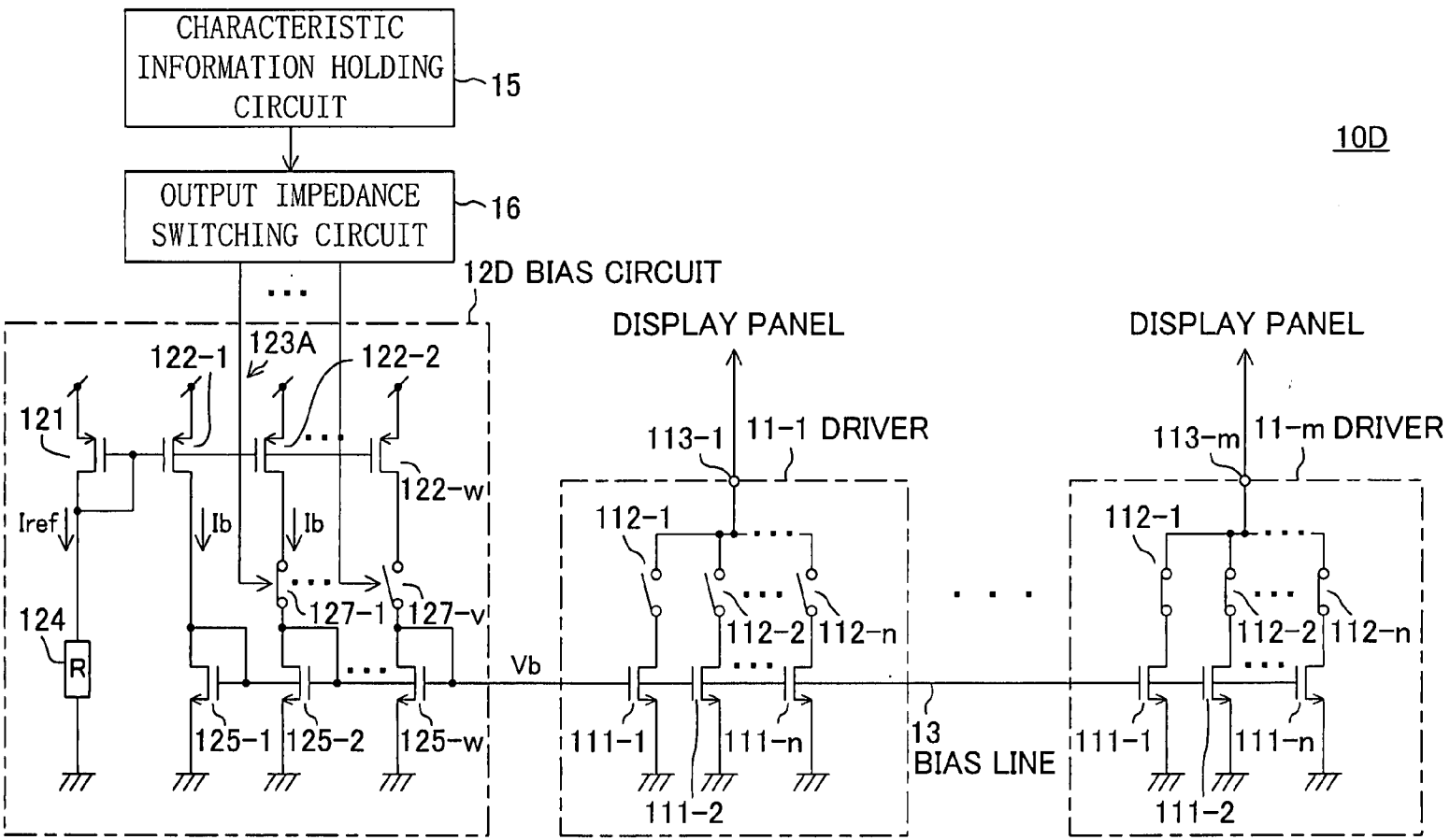
FIG. 4 is a circuit diagram showing a current drive system according to a fourth embodiment of the present invention.

FIG. 4 shows a circuit configuration of a current drive system according to a fourth embodiment of the present invention. A current drive system 10D according to this embodiment includes: m drivers 11-1 to 11-m for driving a display panel; a bias circuit 12D for generating a bias voltage Vb and supplying the bias voltage Vb to the driver 11-i; a characteristic information holding circuit 15 for holding information on a static characteristic of the display panel; and an output impedance switching circuit 16 for switching the output impedance of the bias circuit 12D. The driver 11-i is the same as that described in the conventional system, and thus the description thereof will be omitted. Hereinafter, the bias circuit 12D, the characteristic information holding circuit 15 and the output impedance switching circuit 16 will be described.

The bias circuit 12D has a configuration in which v switches 127-1 to 127-v for performing switching operation to connect or disconnection the drains of p-type transistors 122-2 to 122-w to/from the respective drains of n-type transistors 125-2 to 125-w in a current mirror circuit 123A are added to the bias circuit 12A of the first embodiment. Accordingly, the mirror ratio of the current mirror circuit 123A in the bias circuit 12D and the total resistance value of the n-type transistors 125-1 to 125-w as a voltage generator generating the bias voltage Vb are changeable by appropriately operating the switches 127-1 to 127-v. If a large number of switches are turned ON, the output impedance of the bias circuit 12D is reduced.

The characteristic information holding circuit 15 is constituted by memories or registers, for example, and holds information on a static characteristic of the display panel to be driven. Examples of the static characteristic include the parasitic capacitance 31-i shown in FIG. 10. In an organic EL panel, for example, a power supply is placed in the panel. Therefore, the voltage from this power supply can be considered to be also a static characteristic of the display panel.

The output impedance switching circuit 16 controls the switching operation of the switches 127-1 to 127-v in the bias circuit 12D to switch the output impedance of the bias circuit 12D. The output impedance is switched based on the information on the static characteristic of the display panel held by the characteristic information holding circuit 15.

Specifically, in a case where the characteristic information holding circuit 15 holds information on the parasitic capacitance in the display panel, if the parasitic capacitance is relatively large, the output impedance switching circuit 16 sets the output impedance of the bias circuit 12D relatively low, while setting the output impedance of the bias circuit 12D relatively high if the parasitic capacitance is relatively small. This is because of the following reasons. If the parasitic capacitance is large, a large amount of charge might flow from the display panel to considerably change the voltage on the bias line 13, so that it is necessary to keep the output impedance of the bias circuit 12D sufficiently low. On the other hand, if the parasitic capacitance is small, the voltage variation on the bias line 13 caused by induction is also small, so that no inconveniences will occur even if the output impedance of the bias circuit 12D is high to some degree.

In this manner, for a relatively-small display panel for use in a cellular phone, a PDA (personal digital assistant) or others, i.e., a display panel having small parasitic capacitance, the output impedance of the bias circuit 12D is set high to suppress feed-through current and idle current in the bias circuit 12D, thereby reducing power consumption of the current drive system 10D. The output impedance of the bias current 12D should be, of course, at such a level that the voltage variation, i.e., rising or falling of voltage, caused on the bias line 13 converges within a period during which display data is written.

On the other hand, for a relatively-large display panel for use in a television receiver, a monitor of electronic equipment or others, i.e., a display panel having large parasitic capacitance, the output impedance of the bias circuit 12D is set low enough to have the voltage variation, i.e., rising or falling of voltage, caused on the bias line 13 converge within the period during which display data is written, thus avoiding display crosstalk.

Specifically, in a case where the characteristic information holding circuit 15 holds information on the power-supply voltage of the display panel, if the power-supply voltage is relatively high, the output impedance switching circuit 16 sets the output impedance of the bias circuit 12D relatively low, while setting the output impedance of the bias circuit 12D relatively high if the power-supply voltage is relatively low. This is because of the following reasons. If the power-supply voltage is high, a large amount of charge might flow from the display panel to considerably change the voltage on the bias line 13, so that it is necessary to keep the output impedance of the bias circuit 12D sufficiently low. On the other hand, if the power-supply voltage is low, the voltage variation on the bias line 13 caused by induction is also small, so that no inconveniences will occur even if the output impedance of the bias circuit 12D is high to some degree.

The characteristics of TFTs constituting a plurality of display element circuits in a display panel vary among the TFTs. To avoid the influence of this variation, a certain operational margin needs to be secured. This requires a higher power-supply voltage in the display panel. In such a case where the power-supply voltage of the display panel is relatively high, the output impedance of the bias circuit 12D is set low to such a degree that the voltage variation, i.e., rising or falling of voltage, caused on the bias line 13 converges within a period during which display data is written, thus avoiding display crosstalk.

On the other hand, if the power-supply voltage of the display panel is relatively low, the output impedance of the bias circuit 12D is set high to suppress feed-through current or idle current in the bias current 12D, thus reducing power consumption of the current drive system 10D. The output impedance of the bias current 12D should be, of course, at such a level that the voltage variation, i.e., rising or falling of voltage, caused on the bias line 13 converges within the period during which display data is written.

As described above, in this embodiment, the output impedance of the bias circuit 12D is appropriately switched in accordance with a static characteristic of the display panel, so that power consumption of the current drive system 10D is optimized with display crosstalk avoided.

The characteristic information holding circuit 15 may be omitted. In such a case, the output impedance switching circuit 16 operates based on information supplied from the outside of the current drive system 10D.

Embodiment 5

Figure 5:
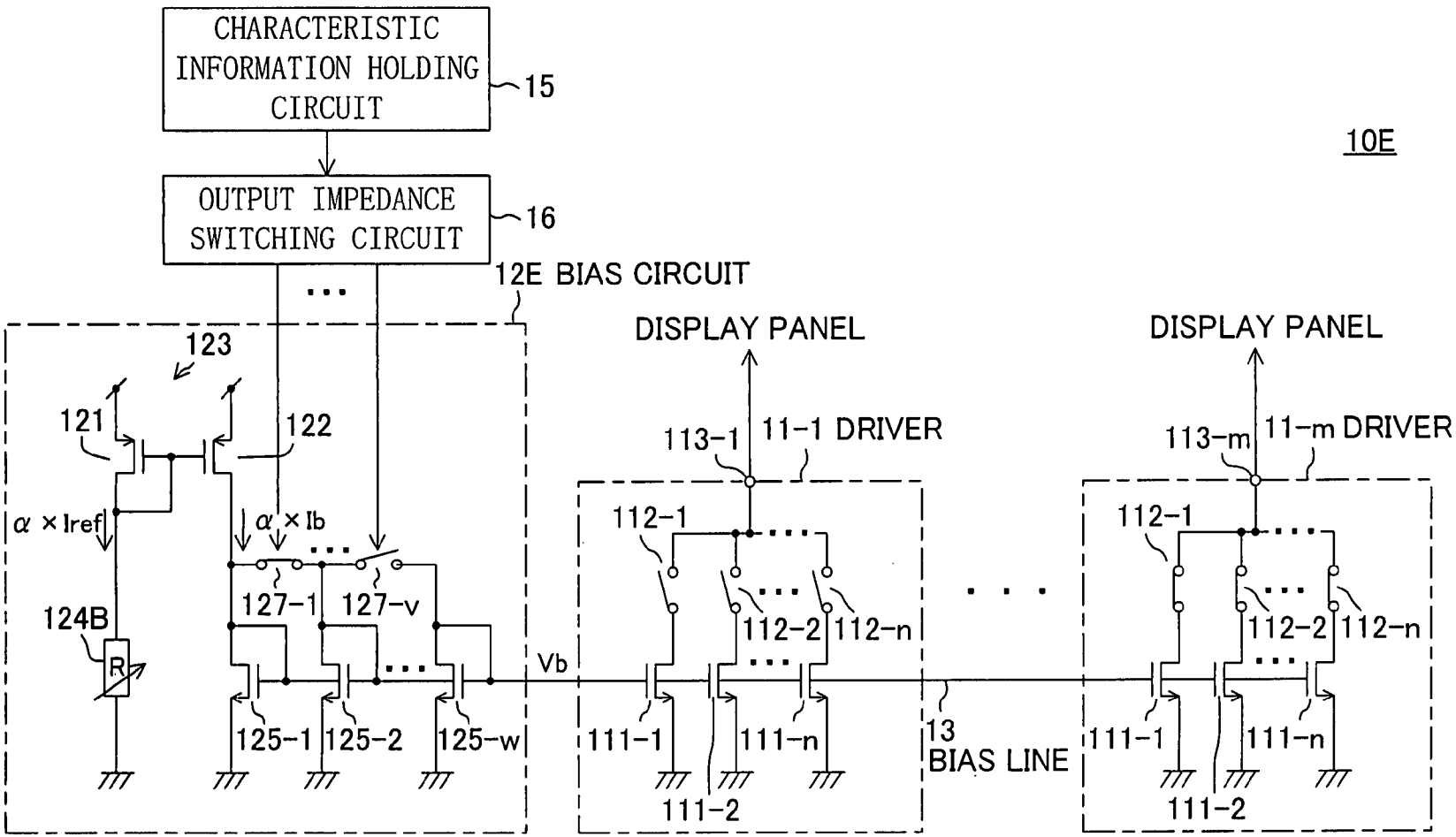
FIG. 5 is a circuit diagram showing a current drive system according to a fifth embodiment of the present invention.

FIG. 5 is a circuit diagram showing a current drive system according to a fifth embodiment of the present invention. A current drive system 10E according to this embodiment includes: m drivers 11-1 to 11-m for driving a display panel; a bias circuit 12E for generating a bias voltage Vb and supplying the bias voltage Vb to the driver 11-i; a characteristic information holding circuit 15 for holding information on a static characteristic of the display panel; and an output impedance switching circuit 16 for switching the output impedance of the bias circuit 12E. The driver 11-i, the characteristic information holding circuit 15 and the output impedance switching circuit 16 are the same as those described in the fourth embodiment, and thus the description thereof will be omitted. Hereinafter, the bias circuit 12E will be described.

The bias circuit 12E has a configuration in which v switches 127-1 to 127-v for performing switching operation to connect or disconnect the drains of n-type transistors 125-1 to 125-w are added to the bias circuit 12B of the second embodiment. The value of a reference current Iref flowing at the input side of a current mirror circuit 123 is changeable using a variable resistor 124B. That is, the total resistance value of the n-type transistors 125-1 to 125-w as a voltage generator generating the bias voltage Vb is changeable by appropriately operating the switches 127-1 to 127-v.

The variable resistance 124B is adjusted in accordance with the total resistance value of the n-type transistors 125-1 to 125-w to change the value of the reference current. For example, if the number of n-type transistors is $\alpha$, i.e., n-type transistors 125-1 to 125-$\alpha$ are connected in parallel, the reference current is multiplied by $\alpha$. Accordingly, the bias current generated by the current mirror circuit 123 is also multiplied by $\alpha$, so that the bias voltage Vb is generated by the n-type transistor 125k. If the number of the n-type transistors 125-k is increased, the output impedance of the bias current 12E is reduced.

As described above, in this embodiment, the number of transistors to be switched is smaller than in the bias circuit 12D of the fourth embodiment, so that a current drive system is implemented with a smaller circuit area.

The characteristic information holding circuit 15 may be omitted. In such a case, the output impedance switching circuit 16 operates based on information supplied from the outside of the current drive system 10E.

Embodiment 6

Figure 6:
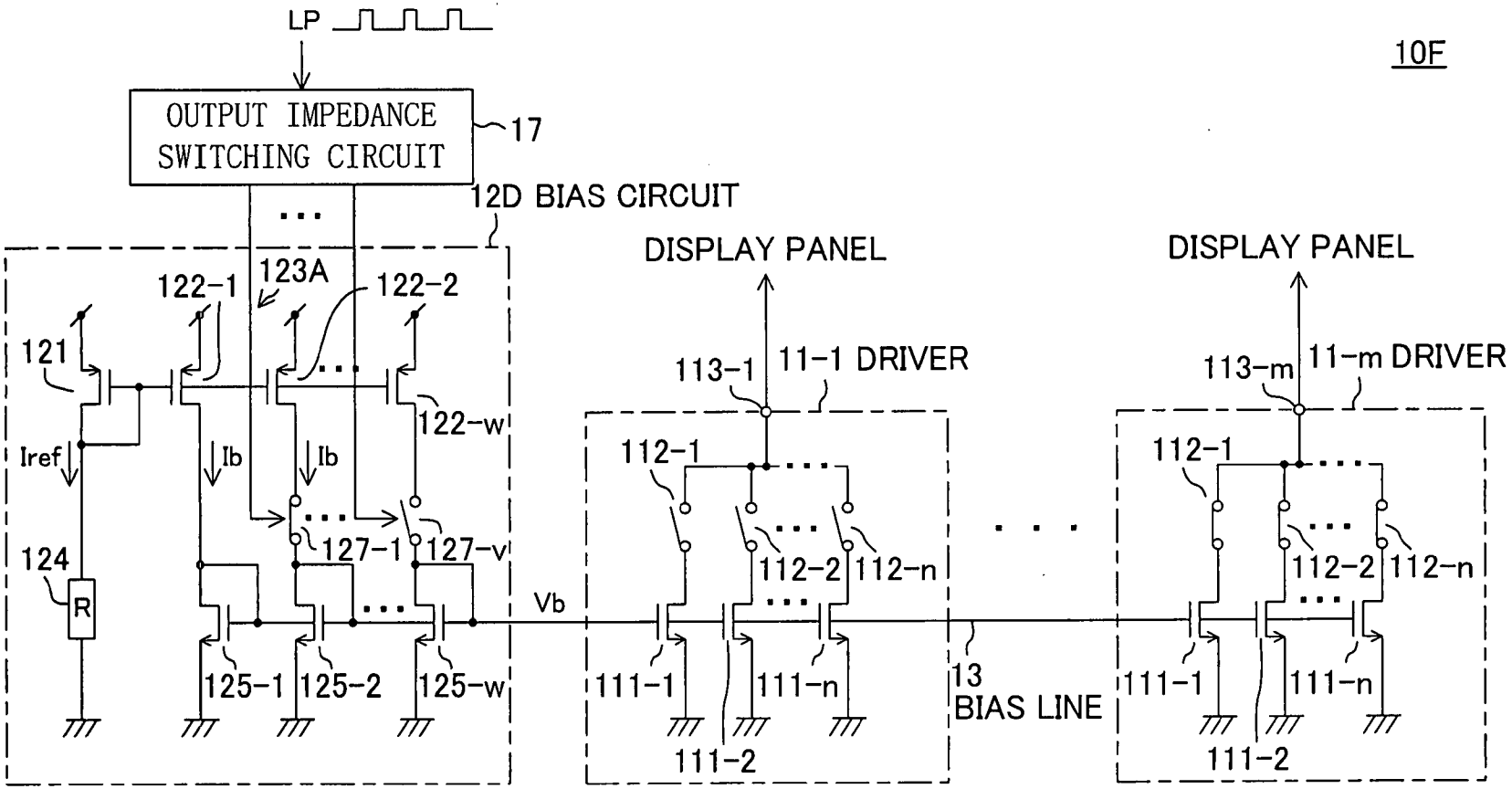
FIG. 6 is a circuit diagram showing a current drive system according to a sixth embodiment of the present invention.

FIG. 6 is a circuit diagram showing a current drive system according to a sixth embodiment of the present invention. A current drive system 10F according to this embodiment has a configuration in which the characteristic information holding circuit 15 in the current drive system 10D of the fourth embodiment is omitted and an output impedance switching circuit 17 for dynamically switching the output impedance of the bias circuit 12D is added instead of the output impedance switching circuit 16. Hereinafter, the output impedance switching circuit 17 will be described.

The output impedance switching circuit 17 controls switches 127-1 to 127-v in accordance with a load pulse signal LP as a pulse signal indicating the timing of writing display data, and sets the output impedance of the bias circuit 12D low in a given period starting with the reception of the load pulse signal LP. This given period is, of course, long enough to have a voltage variation, i.e., rising or falling of voltage, caused on a bias line 13 converge within one horizontal period (hereinafter, referred to as a 1H period).

Figure 7:
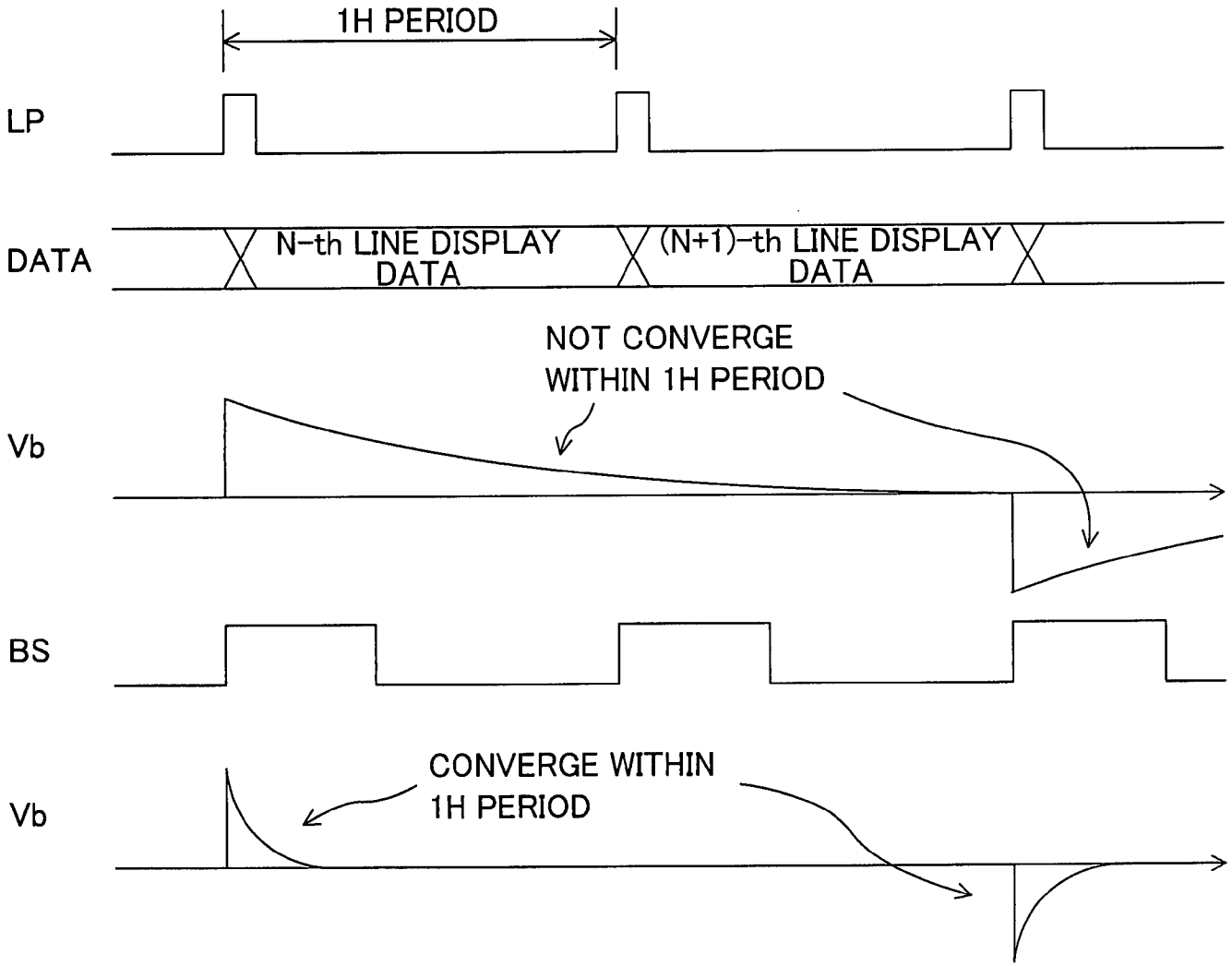
FIG. 7 is a timing chart of an output impedance switching circuit in the current driving system shown in FIG. 6.

Hereinafter, control operation of the output impedance switching circuit 17 will be described with reference to the timing chart shown in FIG. 7.

The display panel is driven at every 1H period indicated by the load pulse signal LP as a period during which display data is written. Specifically, display data DATA for the N-th line in the display panel is written in a 1H period, and then display data DATA for the (N+1)-th line is written in the next 1H period. The actual time required for writing display data varies depending on the characteristics of the display panel. For example, for a relatively-small display panel, writing of display data is completed within a sufficiently-short writing period in the 1H period.

In the conventional current drive system 100 shown in FIG. 10, the voltage variation, i.e., rising or falling of voltage, caused on the bias line 13 does not converge within a 1H period, resulting in the occurrence of display crosstalk, as described above. On the other hand, in the current drive system 10F of this embodiment, if a boost signal BS generated in synchronization with the load pulse signal LP is at a given logic level, e.g., "H", the output impedance of the bias circuit 12D is set low. If the boost signal BS is at "L", the output impedance of the bias current 12D is returned to the original level. This is because no inconveniences will occur even if the output impedance of the bias circuit 12D returns to the original high level in order to suppress power consumption after the voltage variation on the bias line 13 has converged by setting the output impedance of the bias circuit 12D low in a given period.

As described above, the output impedance of the bias circuit 12D is dynamically switched in accordance with the load pulse signal LP, so that power consumption of the current drive system 10D is optimized with display crosstalk avoided.

In this embodiment, the load pulse signal LP and boost signal BS are independent of each other. However, the boost signal BS may be used as the load pulse signal LP. In such a case, the number of signals necessary for controlling switching of the output impedance of the bias circuit 12D is reduced.

Embodiment 7

Figure 8:
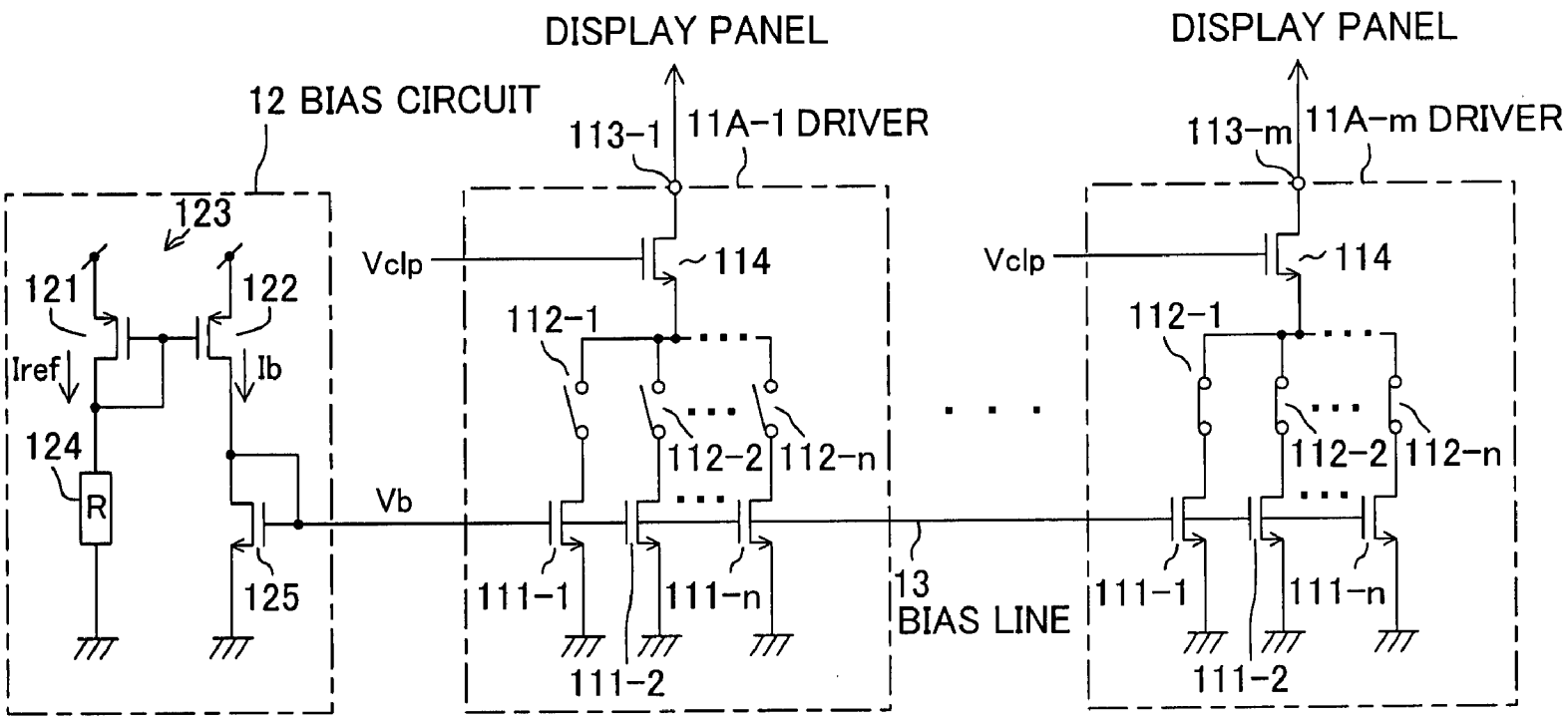
FIG. 8 is a circuit diagram showing a current drive system according to a seventh embodiment of the present invention.

FIG. 8 is a circuit diagram showing a current drive system according to a seventh embodiment of the present invention. A current drive system 10G according to this embodiment includes: m drivers 11A-1 to 11A-m for driving a display panel; and a bias circuit 12 for generating a bias voltage Vb and supplying the bias voltage Vb to the driver 11A-i. The bias circuit 12 is the same as that described in the conventional system, and thus the description thereof will be omitted. Hereinafter, the driver 11A-i will be described.

In the driver 11A-i of this embodiment, an n-type transistor 114 as a current limiting means for limiting a current flowing from the display panel when all the switches 112-1 to 112-n turn ON at the same time is added to the driver 11-i in the conventional current drive system 100 shown in FIG. 10, between the switches 112-1 to 112-n and an output terminal 113-i.

The gate voltage Vclp of the n-type transistor 114 is set lower than the power-supply voltage of the display panel. Accordingly, the n-type transistor 114 operate as a clamping circuit and, even if a high voltage is instantaneously applied from the display panel at the turning ON of all the switches 112-1 to 112-n, the voltage applied to the drain of the n-type transistor 111-j is kept at the gate voltage Vclp or lower. As a result, the bias line 13 is less affected by induction from the display panel. The gate voltage Vclp of the n-type transistor 114 applied to the drain of the n-type transistor 111-j should be, of course, set at a level enough to activate the n-type transistor 111-j.

As described above, in this embodiment, the current limiting means is provided to reduce the influence of induction from the display panel, so that a current drive system preventing display crosstalk and producing a uniform display is implemented relatively easily.

Instead of the n-type transistor 114, a resistance such as a polysilicon resistance, a diffusion resistance or a well resistance may be provided as a current limiting means. In a semiconductor integrated circuit, a current limiting resistance or preventing charge from flowing from the outside is generally provided to protect an internal circuit against electrostatic breakdown. This resistance herein limits the flow of charge from the display panel and removes a high-frequency component. The removal of the high-frequency component makes a parasitic capacitances less affect the coupling between the gate and drain of the n-type transistor 111-j, so that a voltage variation due to induction is less liable to occur on the bias line 13.

Embodiment 8

Figure 9:
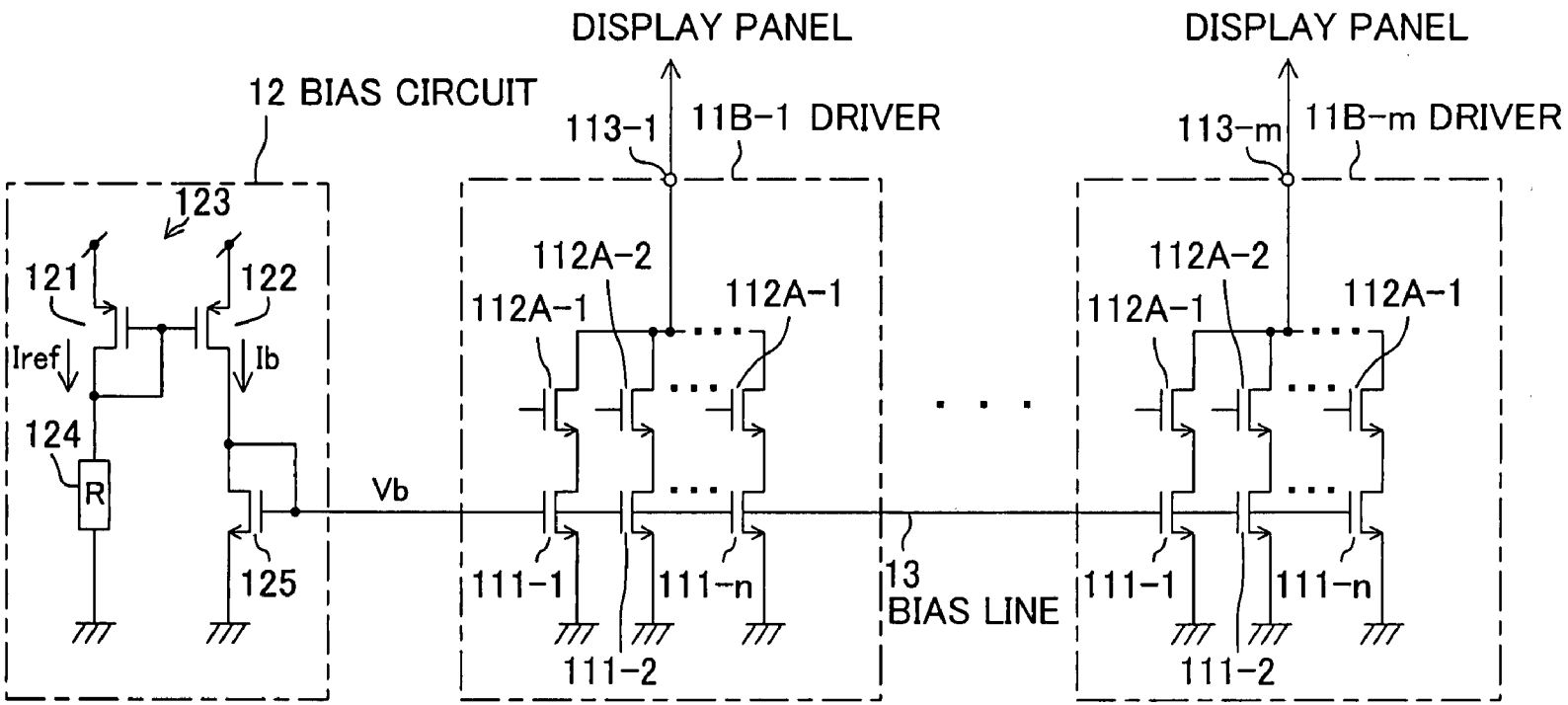
FIG. 9 is a circuit diagram showing a current drive system according to an eighth embodiment of the present invention.

FIG. 9 is a circuit diagram showing a current drive system according to an eighth embodiment of the present invention. A current drive system 10H according to this embodiment includes: m drivers 11B-1 to 11B-m for driving a display panel; and a bias circuit 12 for generating a bias voltage Vb and supplying the bias voltage Vb to the driver 11B-i. The bias circuit 12 is the same as that described in the conventional system, and thus the description thereof will be omitted. Hereinafter, the driver 11B-i will be described.

The driver 11B-i of this embodiment has a configuration in which the n-type transistor 114 in the driver 11A-i of the seventh embodiment is omitted and the switches 112-1 to 112-n are replaced with n-type transistors 112A-1 to 112A-n each serving as a current limiting means. The n-type transistor 112A-j turns ON or OFF in accordance with a gate voltage Vclp already described in the seventh embodiment.

In this manner, in this embodiment, the circuit scale of the driver 11B-i is smaller than in the seventh embodiment, thus implementing a current drive system with a smaller circuit area.

The current drive systems 10A through 10H of the foregoing embodiments are for a display of multiple levels of gray scale. However, the present invention is also applicable to a current drive system for a monochrome display. In such a case, the same effects are obtained.

In the foregoing embodiments, current drive is conducted by drawing a current from the display panel at a high-potential side into the current drive systems 10A through 10H at a low-potential side. Alternatively, the potential at the current drive systems may be set high so that current be output to the display panel at a low-potential side to conduct current drive. In such a case, the polarity of each transistor is set in the direction opposite to that in the foregoing embodiments.

The components of the current drive systems 10A through 10H of the foregoing embodiments may be appropriately combined. Then, a more-stable current drive system is implemented.

As described above, according to the present invention, a current drive system for driving a display panel avoids display crosstalk on the display panel. This achieves display uniformity on the display panel. In addition, power consumption of the current drive system is optimized for various display panels.

The present invention is effective especially in terms of elimination of display crosstalk and improvement of image quality, considering future increase in size and definition of display panels such as organic EL panels.

What is claimed is:

1. A current drive system for current-driving a plurality of display element circuits in a display panel, the system comprising:

a plurality of drivers associated with the respective display element circuits, each of the drivers including at least one transistor whose gate is connected to a bias line and which allows a current in an amount corresponding to a bias voltage applied through the bias line to flow between the source and drain of the transistor and at least one switch associated with the transistor and performing switching operation based on display data to electrically connect or disconnect the transistor to/from a drive line for driving an associated one of the display element circuits; and a bias circuit having an output impedance which is low enough to have a voltage variation occurring on the bias line due to the switching operation of the switch converge within a period during which the display data is written, the bias circuit generating the bias voltage and outputting the bias voltage to the bias line.

2. The current drive system of claim 1, wherein the bias circuit includes impedance reducing means for reducing the output impedance of the bias circuit and outputting the bias voltage based on a received reference voltage.

3. The current drive system of claim 2, wherein the bias circuit includes:

a current mirror circuit for generating a bias current in an amount corresponding to the amount of a current obtained by multiplying a received reference current by a given mirror ratio; and a voltage generator for receiving the bias current generated by the current mirror circuit and generating the reference voltage.

4. The current drive system of claim 1, further comprising an output impedance switching circuit for switching the output impedance of the bias circuit in accordance with a static characteristic of the display panel.

5. The current drive system of claim 1, wherein the display panel is an organic EL panel.

6. The current drive system of claim 4, wherein the static characteristic of the display panel is a parasitic capacitance on the drive line, and the output impedance switching circuit sets the output impedance of the bias circuit relatively low if the parasitic capacitance is relatively large, while setting the output impedance of the bias circuit relatively high if the parasitic capacitance is relatively small.

7. The current drive system of claim 4, wherein the static characteristic of the display panel is a power-supply voltage in the display panel, and the output impedance switching circuit sets the output impedance of the bias circuit relatively low if the power-supply voltage is relatively high, while setting the output impedance of the bias circuit relatively high if the power-supply voltage is relatively low.

8. The circuit drive system of claim 4, further comprising a characteristic information holding circuit for holding information on the static characteristic of the display panel, wherein the output impedance switching circuit switches the output impedance of the bias circuit based on the information held by the characteristic information holding circuit.

9. The current drive system of claim 4, wherein the bias circuit includes:

a current mirror circuit for generating a bias current in an amount corresponding to the amount of a current obtained by multiplying a received reference current by a given mirror ratio; and a voltage generator having a given resistance value, receiving the bias current generated by the current mirror circuit and generating the bias voltage at a level according to the given resistance value, and the output impedance switching circuit switches a mirror ratio of the current mirror circuit and the resistance value of the voltage generator, in accordance with the static characteristic of the display panel.

10. The current drive system of claim 4, wherein the bias circuit includes:

a current mirror circuit for generating a bias current in an amount corresponding to the amount of a current obtained by multiplying a received reference current by a given mirror ratio; and a voltage generator having a given resistance value, receiving the bias current generated by the current mirror circuit and generating the bias voltage at a level according to the given resistance value, the output impedance switching circuit switches the resistance value of the voltage generator in accordance with the static characteristic of the display panel, and the amount of the reference current is switched in accordance with switching of the resistance value of the voltage generator.

11. A current drive system for current-driving a plurality of display element circuits in a display panel, the system comprising:

a plurality of drivers associated with the respective display element circuits, each of the drivers including at least one transistor whose gate is connected to a bias line and which allows a current in an amount corresponding to a bias voltage applied through the bias line to flow between the source and drain of the transistor and at least one switch associated with the transistor and performing switching operation based on display data to electrically connect or disconnect the transistor to/from a drive line for driving an associated one of the display element circuits;

a bias circuit for generating the bias voltage and outputting the bias voltage to the bias line; and an output impedance switching circuit for setting an output impedance of the bias circuit relatively low in accordance with a pulse signal indicating a timing of writing the display data, during a given period starting with reception of the pulse signal.

12. The current drive system of claim 11, wherein the pulse signal includes, in the given period, a pulse which holds a given logic level, and the output impedance switching circuit sets the output impedance of the bias circuit relatively low while the pulse signal is at the given logic level.

13. The current drive system of claim 11, wherein the display panel is an organic EL panel.

14. A current drive system for current-driving a plurality of display element circuits in a display panel, the system comprising a plurality of drivers associated with the respective display element circuits, wherein each of the drivers includes:

at least one transistor whose gate is connected to a bias line and which allows a current in an amount corresponding to a bias voltage applied through the bias line to flow between the source and drain of the transistor; and at least one switch associated with the transistor and performing switching operation based on display data to electrically connect or disconnect the transistor to/from a drive line for driving an associated one of the display element circuits; and current limiting means for limiting a current flowing from the drive line while the switch is ON such that a voltage variation on the bias line caused by the current converges within a period during which the display data is written.

15. The current drive system of claim 14, wherein the switch is a transistor for switching between connection and disconnection between the source and drain thereof based on a control voltage applied to the gate thereof, and also substantially serves as the current limiting means to limit the amount of a current flowing between the source and the drain in a connection state based on the control voltage.

16. The current drive system of claim 14, wherein the display panel is an organic EL panel.

17. A current drive system for current-driving a plurality of display element circuits in a display panel, the system comprising:

a plurality of drivers associated with the respective display element circuits, each of the drivers including at least one transistor whose gate is connected to a bias line and which allows a current in an amount corresponding to a bias voltage applied through the bias line to flow between the source and drain of the transistor and at least one switch associated with the transistor and performing switching operation based on display data to electrically connect or disconnect the transistor to/from a drive line for driving an associated one of the display element circuits;

a bias circuit for generating the bias voltage and outputting the bias voltage to the bias line; and an output impedance switching circuit for switching an output impedance of the bias circuit in accordance with a static characteristic of the display panel.

18. The current drive system of claim 17, wherein the static characteristic of the display panel is a parasitic capacitance on the drive line, and the output impedance switching circuit sets the output impedance of the bias circuit relatively low if the parasitic capacitance is relatively large, while setting the output impedance of the bias circuit relatively high if the parasitic capacitance is relatively small.

19. The current drive system of claim 17, wherein the static characteristic of the display panel is a power-supply voltage in the display panel, and the output impedance switching circuit sets the output impedance of the bias circuit relatively low if the power-supply voltage is relatively high, while setting the output impedance of the bias circuit relatively high if the power-supply voltage is relatively low.

20. The circuit drive system of claim 17, further comprising a characteristic information holding circuit for holding information on the static characteristic of the display panel, wherein the output impedance switching circuit switches the output impedance of the bias circuit based on the information held by the characteristic information holding circuit.

21. The current drive system of claim 17, wherein the bias circuit includes:

a current mirror circuit for generating a bias current in an amount corresponding to the amount of a current obtained by multiplying a received reference current by a given mirror ratio; and a voltage generator having a given resistance value, receiving the bias current generated by the current mirror circuit and generating the bias voltage at a level according to the given resistance value, and the output impedance switching circuit switches a mirror ratio of the current mirror circuit and the resistance value of the voltage generator, in accordance with the static characteristic of the display panel.

22. The current drive system of claim 17, wherein the bias circuit includes:

a current mirror circuit for generating a bias current in an amount corresponding to the amount of a current obtained by multiplying a received reference current by a given mirror ratio; and a voltage generator having a given resistance value, receiving the bias current generated by the current mirror circuit and generating the bias voltage at a level according to the given resistance value, the output impedance switching circuit switches the resistance value of the voltage generator in accordance with the static characteristic of the display panel, and the amount of the reference current is switched in accordance with switching of the resistance value of the voltage generator.

* * * * *